US005538461A

United States Patent [19]

Tseng

[11] Patent Number: 5,538,461

[45] Date of Patent: Jul. 23, 1996

[54] WORKPIECE PROTECTING WIRE NET USED IN VIBRATION MILLING

[76] Inventor: Shao-Chien Tseng, No. 130, Sec 2. Yang-Shin Rd., Yang-Mei Taoyuan 326, Taiwan

[21] Appl. No.: 423,138

[22] Filed: Apr. 18, 1995

[51] Int. Cl.[6] ..... B24B 31/12

[52] U.S. Cl. ..... 451/113; 451/452

[58] Field of Search ..... 451/113, 104, 451/326, 85, 457, 452, 32

[56] References Cited

U.S. PATENT DOCUMENTS

| | | | |
|---|---|---|---|
| 1,921,267 | 8/1933 | Smith | 451/32 |
| 4,566,144 | 1/1986 | Arneson | 451/113 |

FOREIGN PATENT DOCUMENTS

| | | | |
|---|---|---|---|
| 0460171 | 2/1975 | U.S.S.R. | 451/326 |

*Primary Examiner*—Robert A. Rose
*Attorney, Agent, or Firm*—Pro-Techtor International

[57] ABSTRACT

A workpiece protecting wire net composed of a spiral spring, and a netting; one end of the spring is formed as a spiral enclosing end, while the other end thereof a hollow openning end, milled workpieces are placed in the chamber of the spring through the opening end, the netting is then put on the spring to have each pitch and the openning end of the spring covered thereby; in a grinding fluid for three dimensional vibration milling in a tank, meshes of the net allow grinding medium and the fluid to penetrate freely so as to adequately transmit a vibration action, and to render the medium and the fluid to grind the surfaces of the workpieces, and to protect the workpieces in the net from collision or tangling with one another, and protection of the spring can be achievced here by the PE netting.

3 Claims, 7 Drawing Sheets

WORKPIECE PROTECTING WIRE NET USED IN VIBRATION MILLING

BACKGROUND OF THE INVENTION

1. Field of the Invention

The present invention relates to the structure of a workpiece protecting wire net for use in vibration milling, and especially to a protecting wire net which can protect the workpieces from collision with and hurt to one another, and also can increase frequency of scouring as well as abrasion of the grinding fluid and the grinding grains on the fine slits on the workpieces, thus elevates the effects of grinding, such effect is even more distinctive on the normal workpieces which are in various shapes and larger and are highly harder to be milled.

2. Description of the Prior Art

The technique of vibration milling is one which can create sychronic vibration among grinding agents and grinding media (i.e., grinding grains) put in the grinding fluid tank of the vibrating mill by transmission of vibration produced by the vibrating mill, and can render the grinding agents and the grinding grains to collide with one another in many directions, and thus workpieces with surfaces of high smoothness are obtained. However, the vibrating mills having the highest efficiency now used in the markets are those which can render the workpieces, the grinding fluid and the grinding grains mutually to create three dimensional vibration, when in grinding, the coarse texture on the surfaces of the workpieces is ground till it is smooth; whatever multivariance of the vibrasional direction is, collision and tangling among the workpieces in the grinding fluid in the tank is an unevitable disadvantage, so that workpieces of the same composition of elements and of the same hardness will be collided and damaged by one another, the finished workpieces thereby, although have smooth surfaces, do have a lot of fine scratches, this is really a trouble often seen in the field of vibration milling. To eliminate such trouble, manufacturers in the field mostly limited volume, quality or hardness of the milled workpieces, or reduced frequency of vibration but increased time for vibration, in this way, practicality of the vibrating mills is relatively lowered, this is surely not good. Further, polishing of the normal workpieces of various irregular shapes can not be done with a vibrating mill in the markets because of too many fine slits to be created, and normally the three dimensional vibration on the workpieces creates tangling phenomenon, thus impedes operation of vibration milling and increases times of vibration milling on the milled surfaces or slits, such phenomenon can be found most frequently in the inferior vibration milling on the slits on large workpieces, and is a problem unable of being conquered now in the technique of vibration milling in the markets.

SUMMARY OF THE INVENTION

For conquering the problem of the above stated conventional technique of vibration milling, the inventor of the present invention based on his abundant experience of years in processing of precise components, studied hard and finally develops the workpiece protecting wire net of the present invention for giving a protecting net around every workpiece placed in the tank of the grinding fluid, and for preventing collision as well as damage among the workpieces, and for allowing the grinding medium and the grinding fluid to penetrate freely the meshes of the protecting wire net, thus the surfaces of the workpieces and the slits are ground till they are smooth, frequency of vibration for a vibrating mill can be increased, no worry of collision as well as damage among the workpieces is there, a vibrating mill can be used to grind larger or heavier workpieces, or deal with the workpieces having more fine slits to be milled, range of the workpieces that can be milled by a vibrating mill can be enlarged, yet quality and efficiency of production can be elevated.

Accordingly, the primary object of the present invention is to use an easily manufactured spiral spring and a PE netting as the members for a protecting wire net, such that the workpieces being milled are placed in the chamber of the spiral spring, the netting is then put on the spiral spring to have the periphery of the spiral spring covered by the net work, thereby, in the grinding fluid having grinding medium (e.g., grinding grains) for three dimensional vibration milling in a tank, meshes of the net allow the grinding medium and the grinding fluid to penetrate freely therethrough, so as to grind the milled workpieces.

The secondary object of the present invention is to use an easily manufactured spiral spring having pitches or gaps on the spiral for allowing the grinding medium (e.g., grinding grains) and the grinding fluid to penetrate freely through the gaps to collide and grind directly or indirectly the surfaces of the workpieces, while the elasticity of the spiral spring renders the collision between the spring and the grinding medium to produce reaction, i.e., there are vibration of the spiral spring and indirect vibration of the grinding medium, they are transmitted to the workpieces inside, to thereby largely increase vibrational collision.

Another object of present invention is to use many PE nettings put on a plurality of spiral springs to cover the peripheries thereof, such that these spiral springs can be prevented from damage by collision, the the nettings cover each pitch and the openning end of each spiral spring to prevent trouble of tangling among the spiral springs, and to allow the grinding medium and the grinding fluid to penetrate freely therethrough, so as to grind the inside milled workpieces.

The present invention will be apparent in its practical structure and forms-after reading the detailed description of the preferred embodiment thereof in reference to the accompanying drawings.

DETAILED DESCRIPTION OF THE PREFERRED EMBODIMENT

Figure 1:
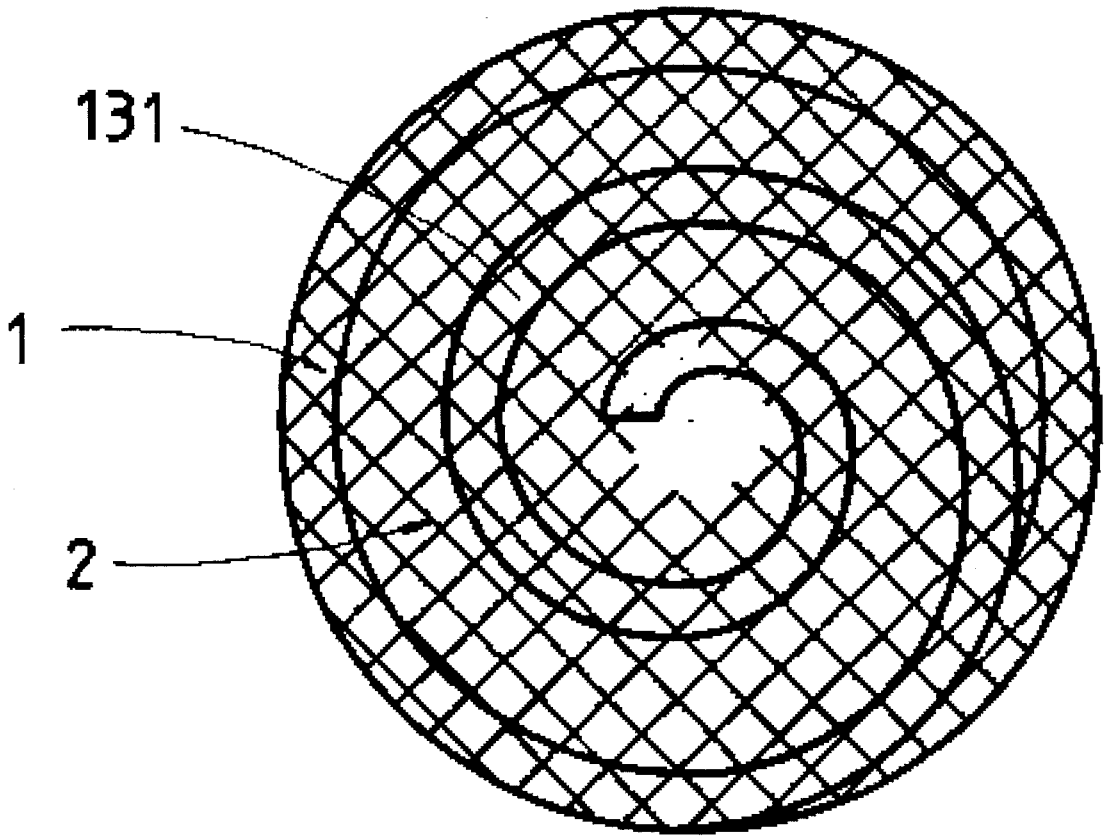
FIG. 1 is a top view of the workpiece protecting wire net of the present invention.
Figure 2:
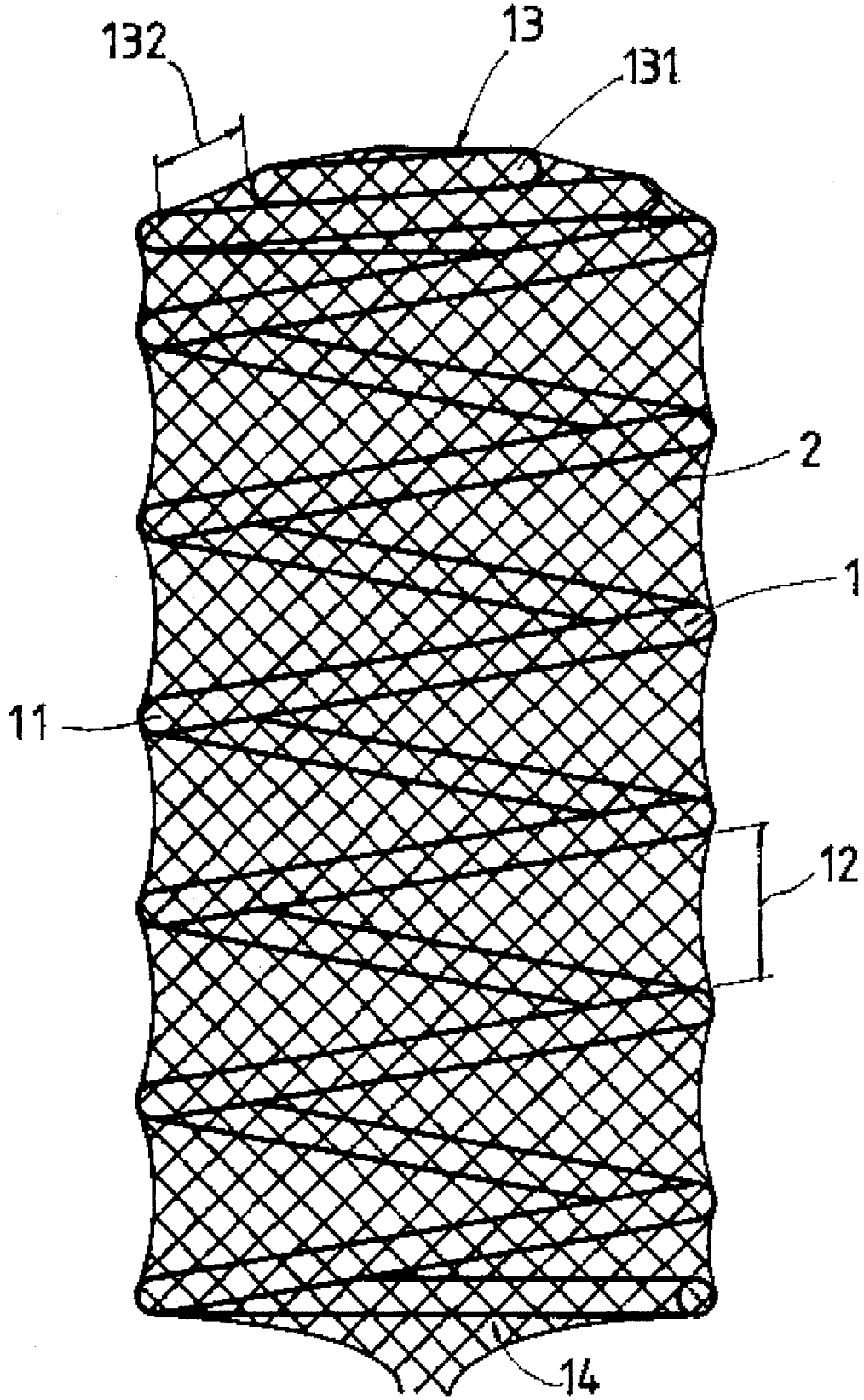
FIG. 2 is a front view of the workpiece protecting wire net of the present invention.
Figure 3:
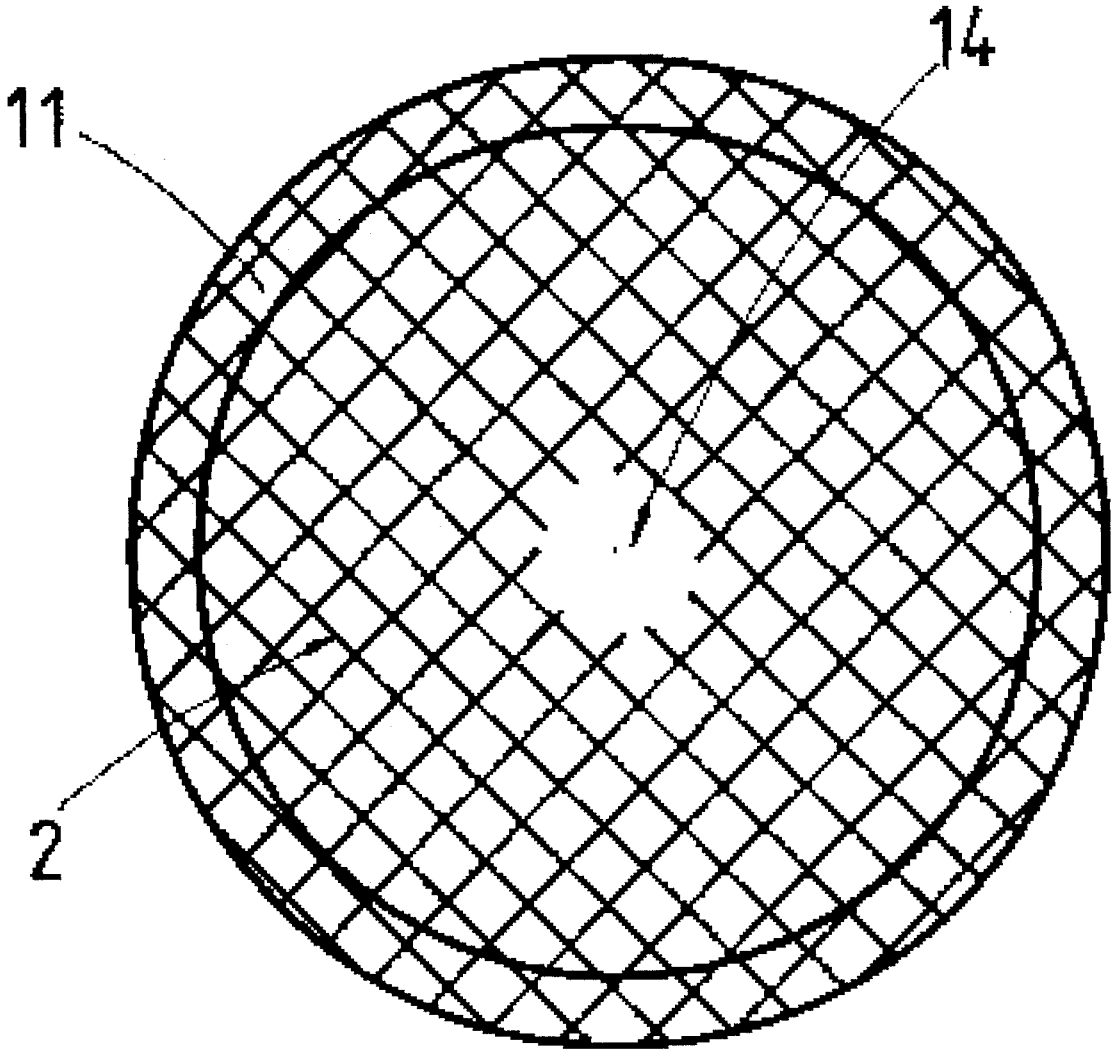
FIG. 3 is a bottom view of the workpiece protecting wire net of the present invention.
Figure 4:
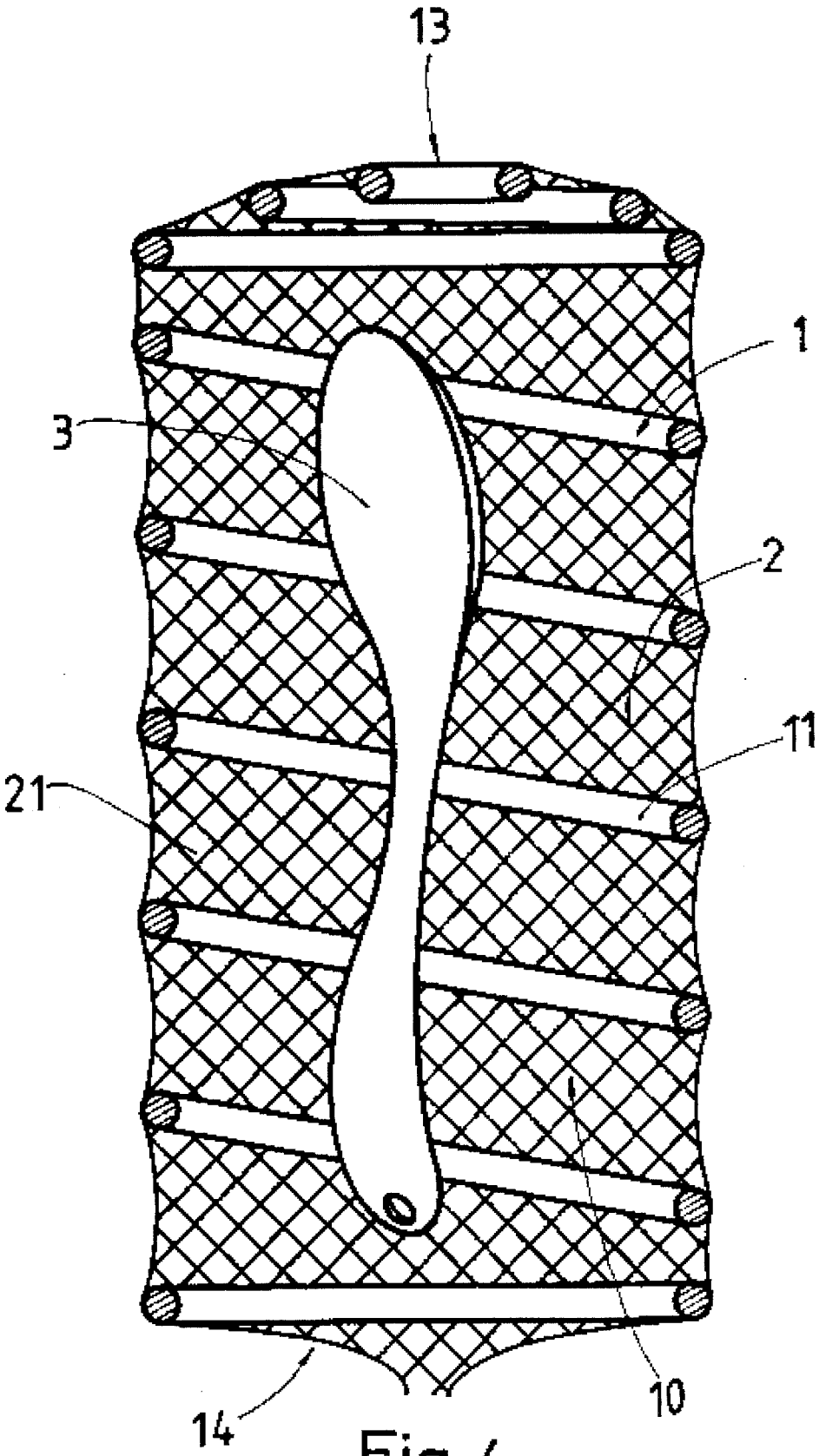
FIG. 4 is a sectional view of a milled workpiece placed in the workpiece protecting wire net of the present invention.
Figure 5:
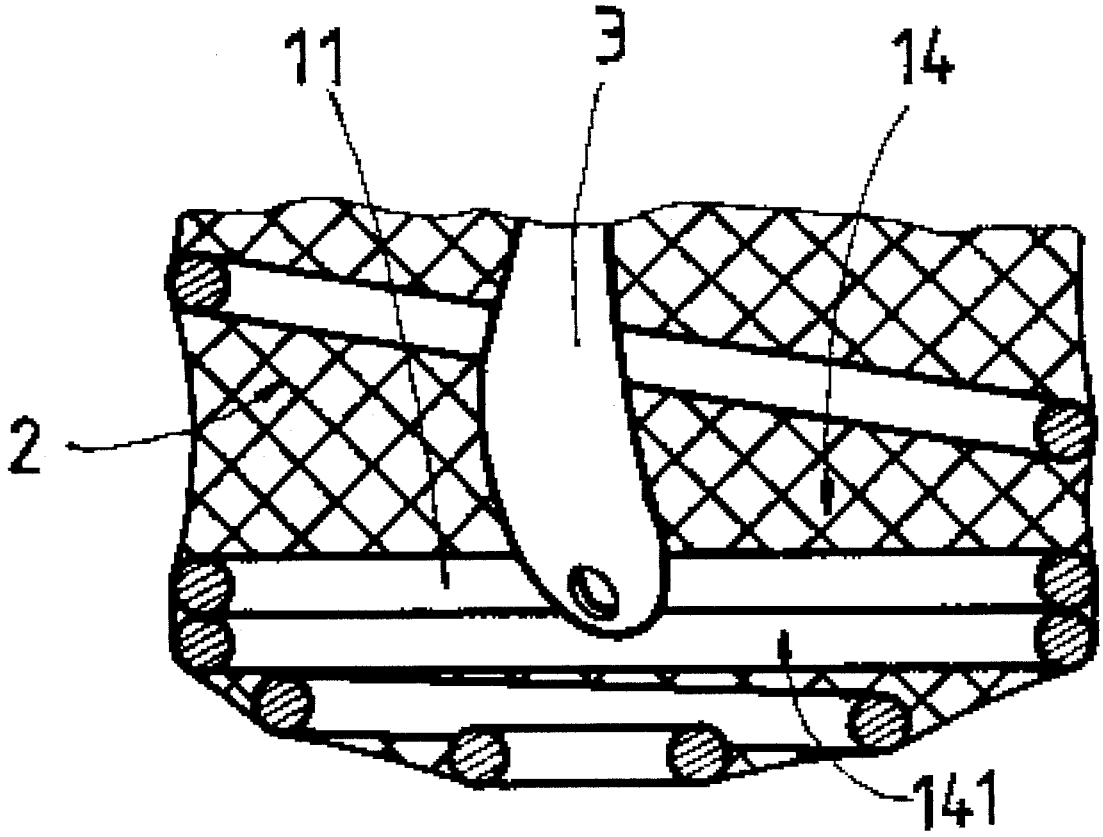
FIG. 5 is a sectional view of an openning end of the workpiece protecting wire net of the present invention, with a bottom spiral attached thereto.
Figure 6:
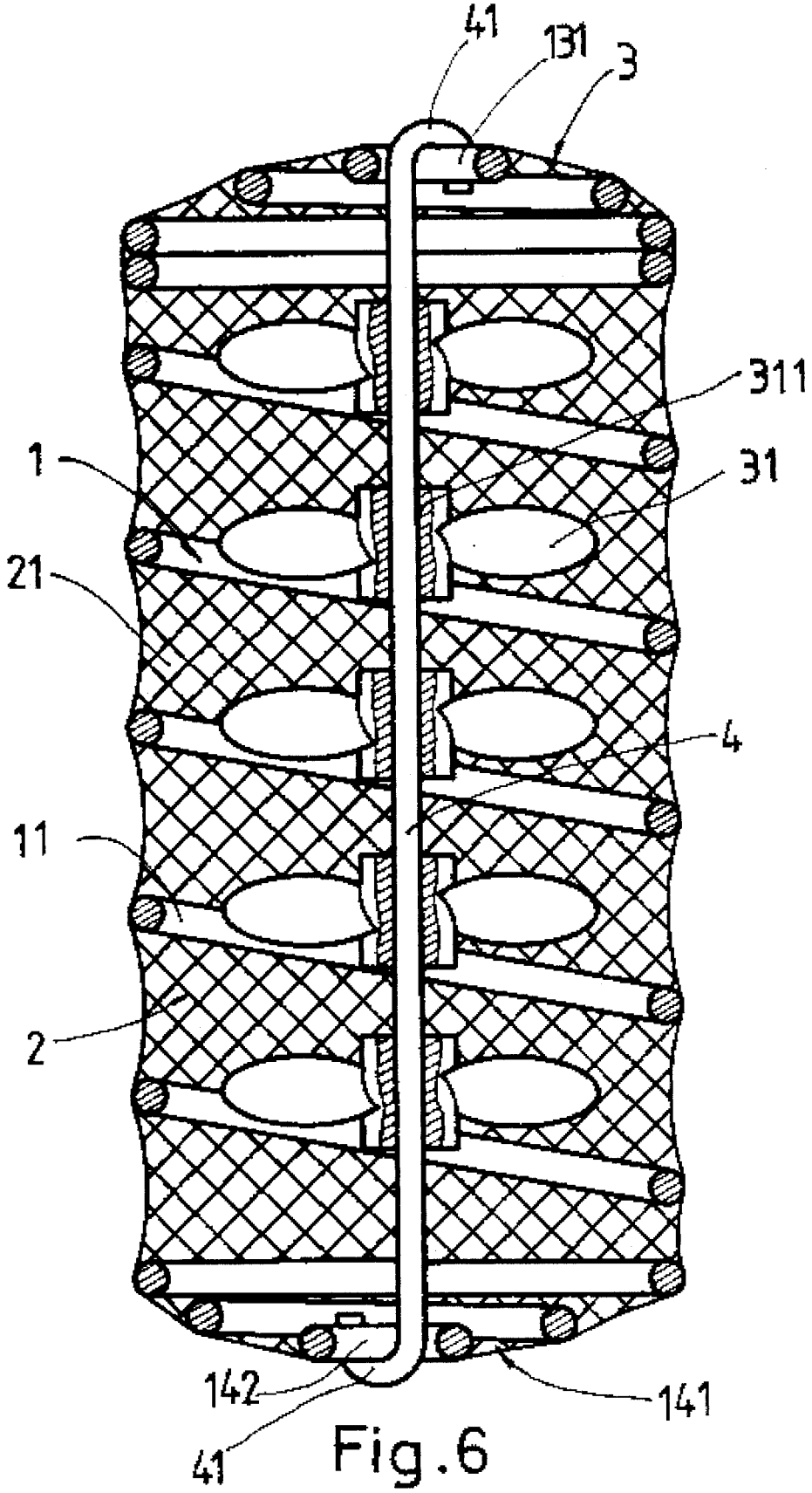
FIG. 6 is a sectional view of the workpiece protecting wire net of the present invention, with a plurality of workpieces having axial holes hung thereon.

Refer to FIG. 1, 2 and 3 at the first, the workpiece protecting wire net of the present invention for vibration milling is composed mainly of a spiral spring 1 and a netting 2 formed from polyvinyl ether PE; wherein the spiral spring 1 has a pitch 12 between every two rounds 11 of the spiral, one end of the spiral spring 1 is formed as a spiral enclosing end 13 of which between every two rounds 131 there is also a pitch 132, while the other end of the spiral spring 1 is formed as a hollow openning end 14, the workpiece 3 being milled is placed in the chamber 10 of the spiral spring 1 through the opening end 14 (referring to FIG. 4), the netting 2 is then put on the spiral spring 1 to have each pitch 12 and the openning end 14 of the spiral spring 1 covered by the netting 2, the size of the meshes 21 of the netting 2 is such that the grinding medium (i.e., grinding grains) and the grinding fluid penetrate them freely. Wherein, the opening end 14 of the spiral spring 1, after the workpiece 3 being milled is placed in the chamber 10 therethrough, can be attached with a bottom spiral 141 just like the spiral enclosing end 13, and is covered and tightly contracted by the netting 2 (as shown in FIG. 5) after attachment of the bottom spiral 141, to thereby increase stability of the workpiece 3 placed in the chamber 10 during the process of vibration milling. Moreover, referring to FIG. 6, as for the workpieces 31 (such as gears, spiral propellers or sleeves) having axial holes 311, the structure of the workpiece protecting wire net of the present invention can have a bar 4 with hooks 41 on both ends thereof hooked with one end on any round 131 of the spiral enclosing end 13 and with the other end on any round 142 of the bottom spiral 141, the axial holes 311 of the workpieces 31 are slipped on the bar 4 to allow vibration milling of the grinding medium and the grinding fluid, thus range of availability of the vibrating mill can be enlarged.

Figure 7:
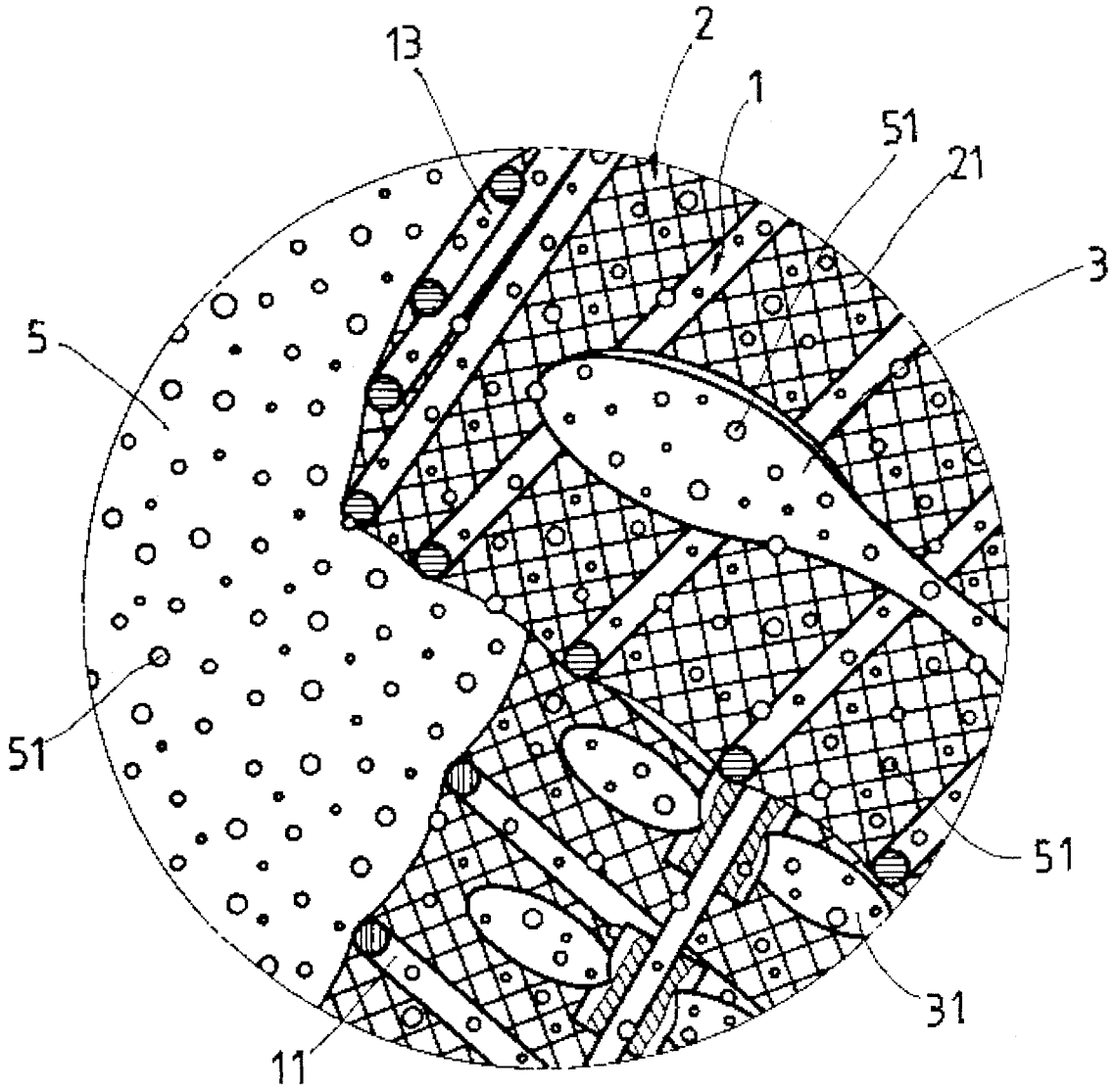
FIG. 7 is a schematic view showing a plurality of workpiece protecting wire nets of the present invention are placed in the grinding medium and the grinding fluid to allow penetration and grinding thereby.

When in the grinding fluid for vibration milling in a tank (as shown in FIG. 7), meshes 21 of every net in the tank allow the grinding medium 51 for the grinding fluid 5 to penetrate freely therethrough, so as to adequately transmit a three dimensional vibration action, and on one hand to grind the surfaces of the milled workpieces 3 or 31, while on the other hand to protect the milled workpieces 3 or 31 in the workpiece protecting wire nets from collision with one another or from tangling or disturbance of the surfaces thereof with one another, and protection of every spiral springs 1 can be achievced here by every PE netting 2.

Size of the pitches 12 of the spiral spring 1 and size of the meshes 21 of the netting 2 can be adjusted in pursuance of the specification for working members in vibration milling and the chosen shape of the grinding medium 51, so as to have the milled workpieces suitably placed in the workpiece protecting wire nets, and to allow the grinding medium 51 to penetrate freely through the meshes 21.

My invention may assume numerous forms and is to be construed as including all modifications and variations falling within the scope of the appended claims.

I claim:

1. A workpiece protecting wire net for vibration milling comprising:

a helical spring with a netting that is placed therearound, coils of said spring being sufficiently spaced so that grinding fluid passes freely therethrough, said spring includes a first open end which is in communication with an open interior chamber of said spring, a second end of said spring includes a first spiral portion to close said second end; such that workpieces being milled are placed in said chamber of said spring through said open end, said netting is then placed on said spring such that said open end of said spring and said spring are covered by said netting.

2. The workpiece protecting wire net of claim 1 wherein:

a second spiral portion is placed in said open end of said spring following insertion of said workpieces into said interior chamber, said second spiral portion thereafter being covered and compressed by said netting.

3. The workpiece protecting wire net of claim 2 wherein:

a first hook on a first end of a bar is affixed to said first spiral portion, and a second hook on a second end of said bar is affixed to said second spiral portion, such that workpieces with holes therein are mounted on said bar to facilitate vibration milling.

* * * * *